US005906515A

United States Patent [19]

Lin

[11] Patent Number: 5,906,515

[45] Date of Patent: May 25, 1999

[54] CONDUCTIVE PLUG DEVICE

[76] Inventor: Mei-Lu Lin, 56, Min Sheng Street, Fengyuan, Taichung Hsien, Taiwan

[21] Appl. No.: 08/926,540

[22] Filed: Sep. 10, 1997

[51] Int. Cl.[6] ..... H01R 13/68

[52] U.S. Cl. ..... 439/622; 337/197

[58] Field of Search ..... 200/547; 439/622, 439/621; 337/197

[56] References Cited

U.S. PATENT DOCUMENTS

| | | | |
|---|---|---|---|
| 4,275,374 | 6/1981 | Chaucer | 337/197 |
| 4,904,976 | 2/1990 | Liag | 337/197 |
| 5,634,818 | 6/1997 | Deng | 439/622 |
| 5,643,012 | 7/1997 | Mai | 439/622 |

*Primary Examiner*—Gary Paumen
*Assistant Examiner*—Alexander Gilman

[57] ABSTRACT

A conductive plug device has a housing, a main body inserted in the housing, and a slide block disposed on the housing. The slide block has a separator plate and two insertion plates. The housing has a first slot receiving the separator plate, a second slot receiving the respective insertion plate, and a third slot receiving the respective insertion plate. A cover plate is disposed in front of the main body. A first conductive plate is disposed in the main body. A second conductive plate is disposed in the main body. A curved plate is disposed in the main body. The separator plate is placed between the second conductive plate and the curved plate. A first wire is connected to the first conductive plate. A second wire is connected to the second conductive plate.

2 Claims, 10 Drawing Sheets

CONDUCTIVE PLUG DEVICE

BACKGROUND OF THE INVENTION

This invention relates to a conductive plug device, and more particularly to a conductive plug device which can prevent dusts and impurities from entering the conductive plug device.

Referring to FIGS. 1 and 2, a conventional conductive plug device 10 comprises a slot 101 receiving a slide block 14, a post 141 disposed on the slide block 14 contacting a conductive plate 13, a curved plate 111 disposed in an interior of the conventional conductive plug device 10, and two blades 11 connected to two wires 12. However, the contact area between the conductive plate 13 and the curved plate 111 is very small. When water, dust or impurity enters the conventional conductive plug device 10, the conductivity between the conductive plate 13 and the curved plate 111 will be poor so that the conventional conductive plug device 10 may be short circuit.

SUMMARY OF THE INVENTION

A main object of this invention is to provide a conductive plug device which has a separator plate to separate a curved plate and a conductive blade completely.

Another object of this invention is to provide a conductive plug device which can prevent dusts and impurities from entering the conductive plug device.

DETAILED DESCRIPTION OF THE INVENTION

Figure 1:
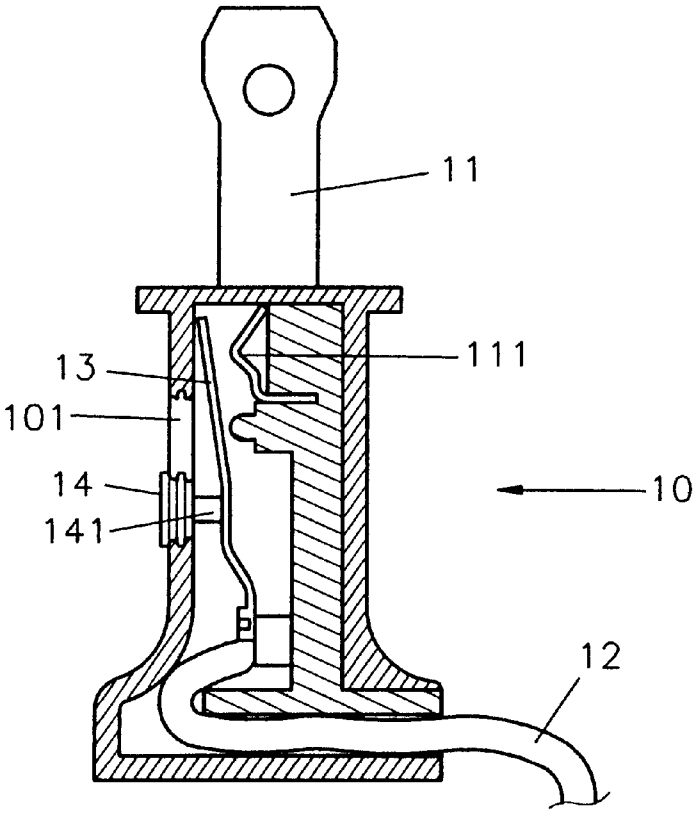
FIG. 1 Prior Art
FIG. 1 is a sectional view of a conventional conductive plug device of the prior art.
Figure 2:
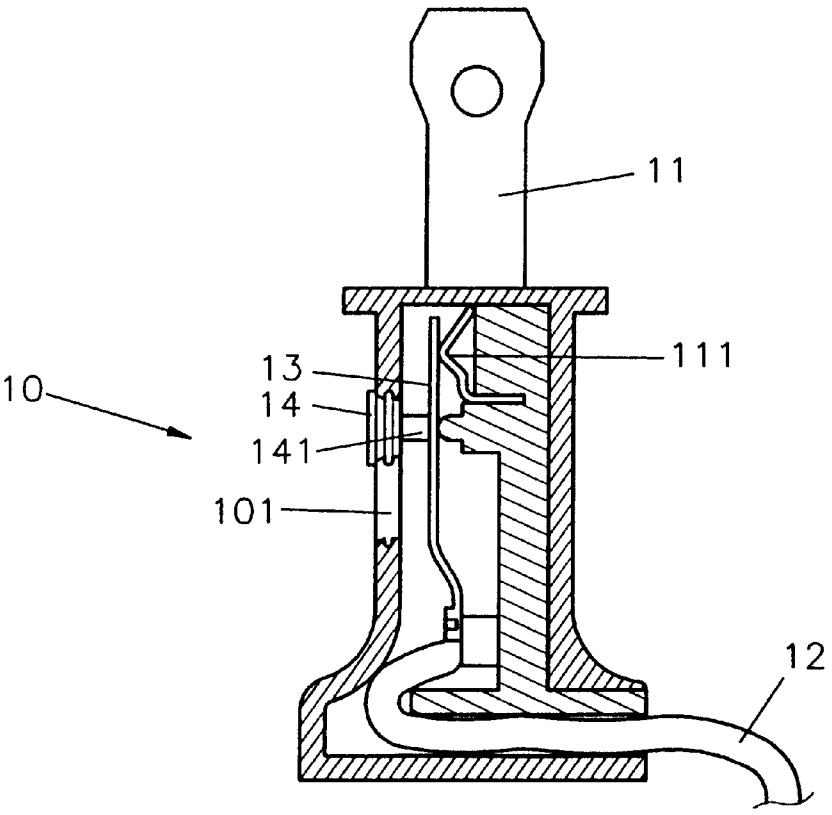
FIG. 2 Prior Art
FIG. 2 is another sectional view of a conventional conductive plug device of the prior art.
Figure 3:
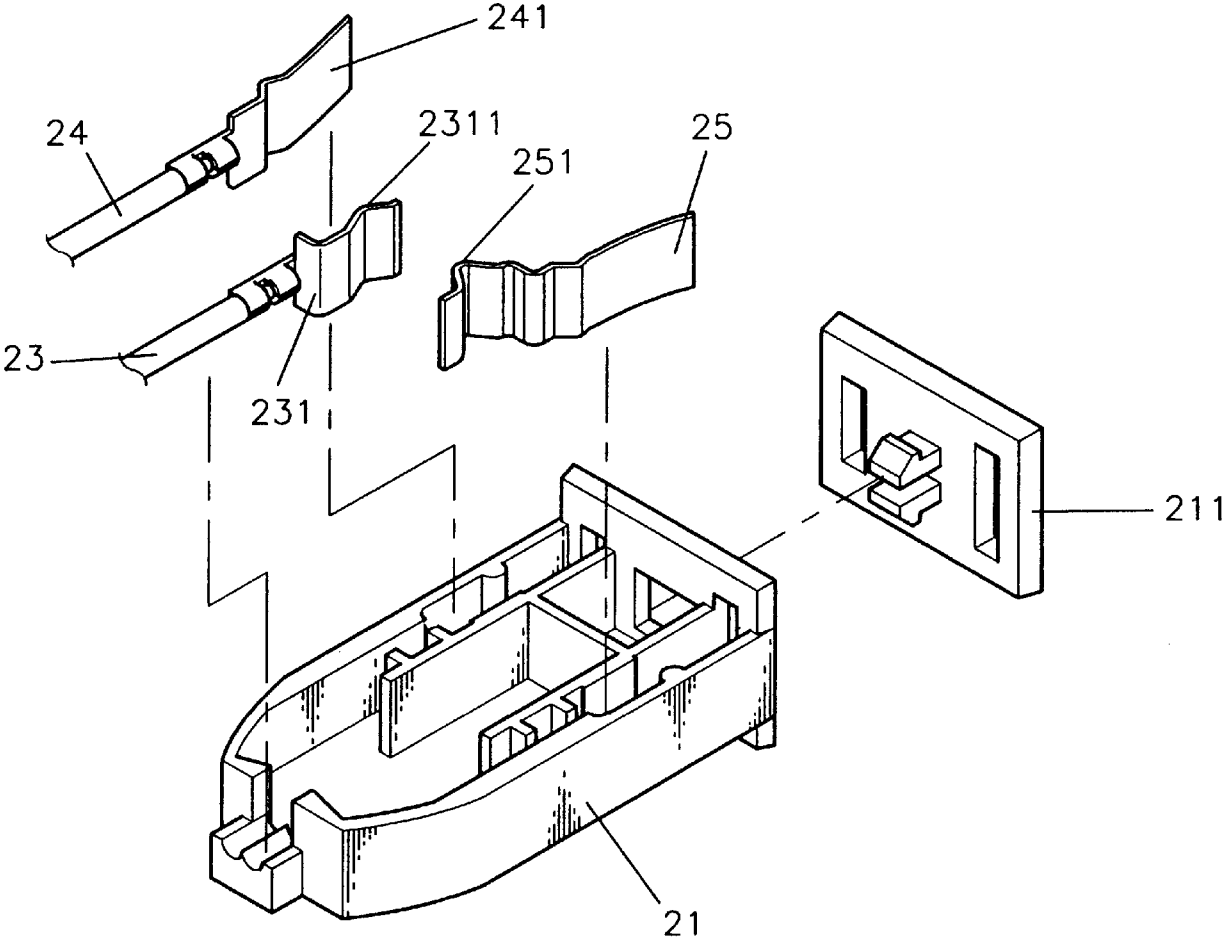
FIG. 3 is a perspective exploded view of a main body of a first preferred embodiment.
Figure 4:
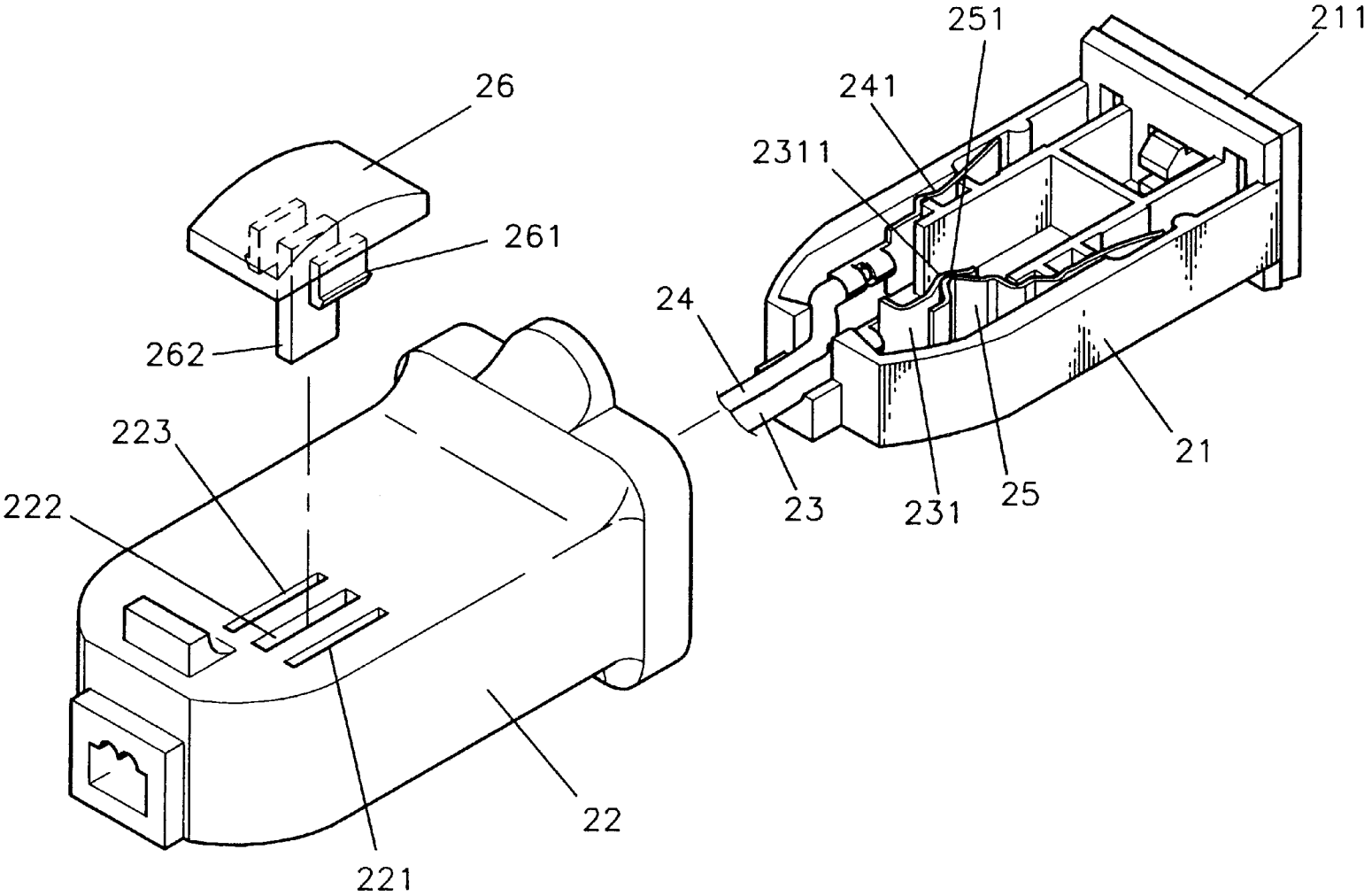
FIG. 4 is a perspective exploded view of a conductive plug device of a first preferred embodiment.
Figure 5:
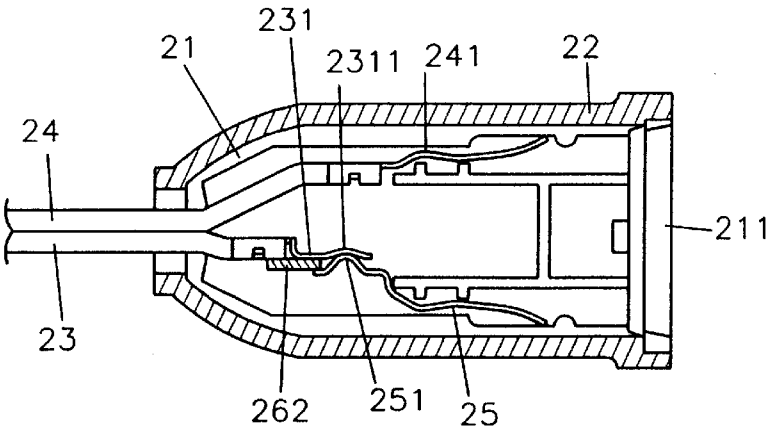
FIG. 5 is a sectional assembly view of a conductive plug device of a first preferred embodiment.
Figure 6:
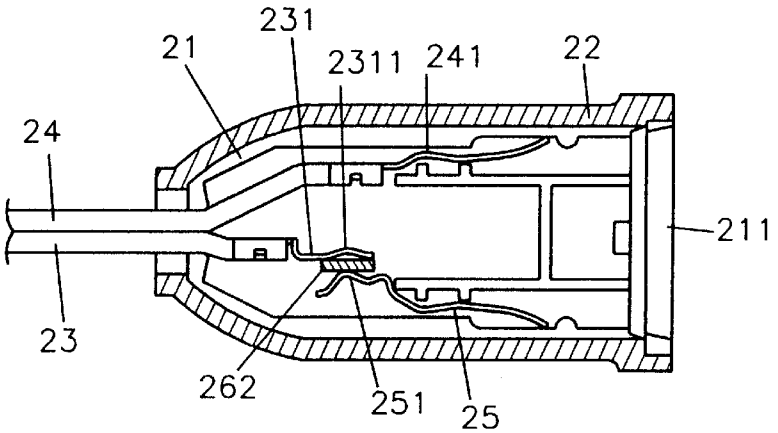
FIG. 6 is another sectional assembly view of a conductive plug device of a first preferred embodiment.
Figure 7:
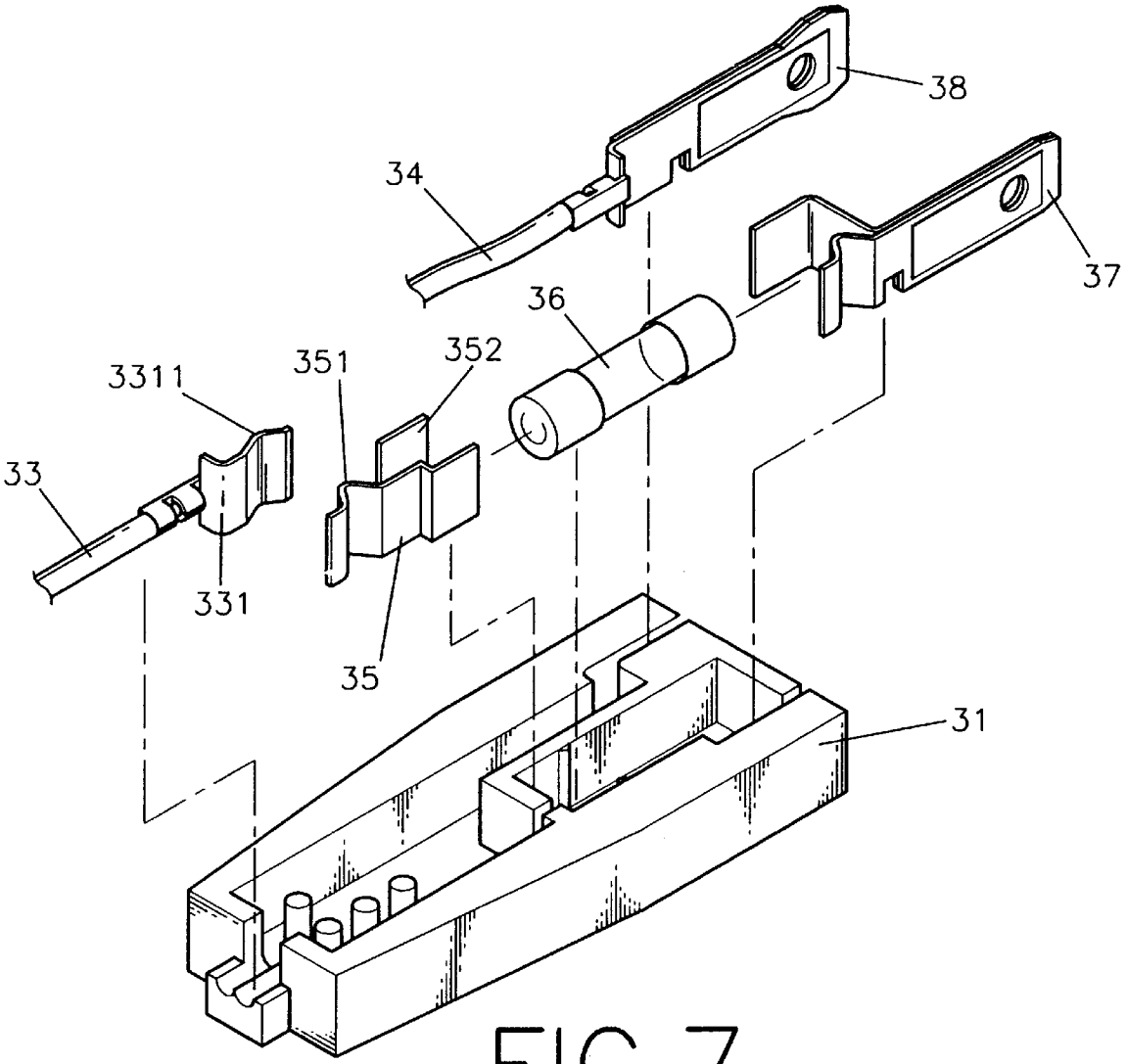
FIG. 7 is a perspective exploded view of a main body of a second preferred embodiment.
Figure 8:
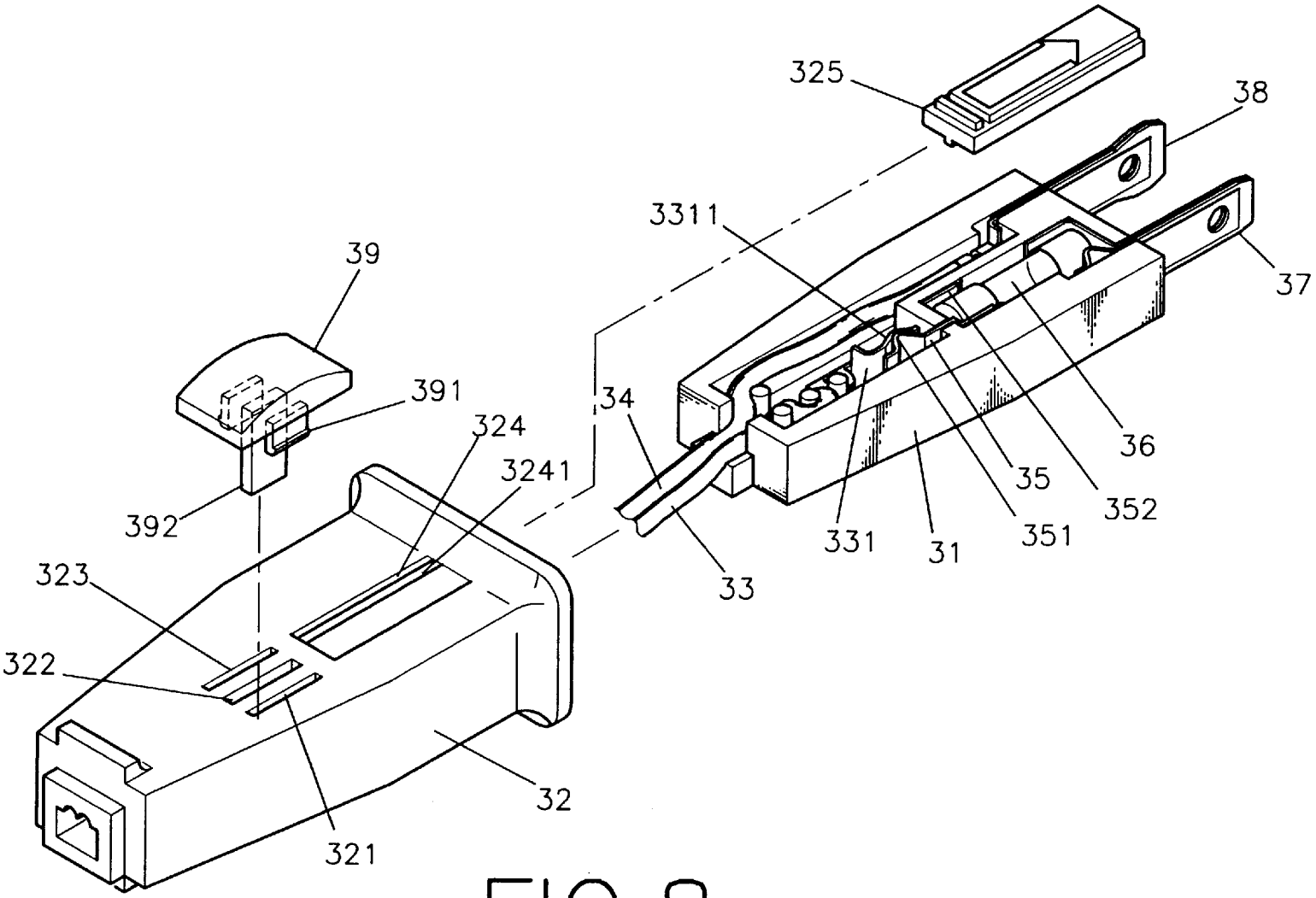
FIG. 8 is a perspective exploded view of a conductive plug device of a second preferred embodiment.
Figure 9:
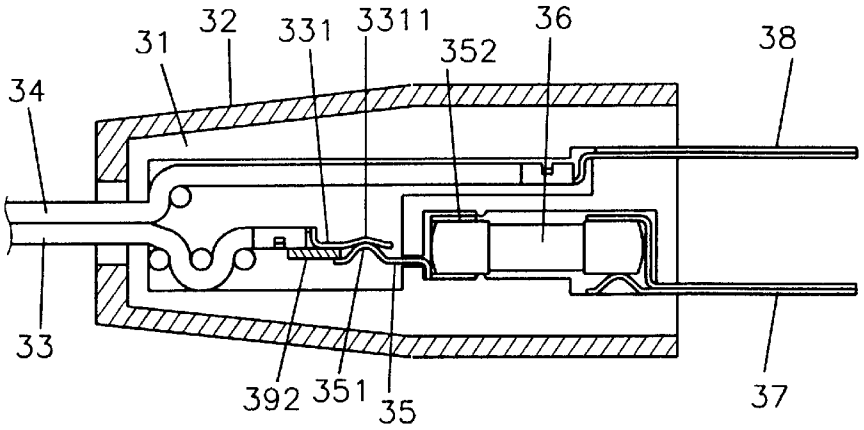
FIG. 9 is a sectional assembly view of a conductive plug device of a second preferred embodiment.
Figure 10:
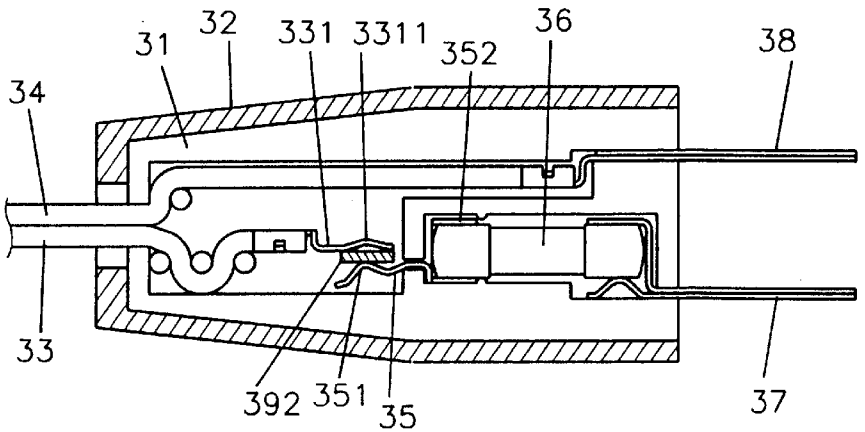
FIG. 10 is another sectional assembly view of a conductive plug device of a second preferred embodiment.
Figure 11:
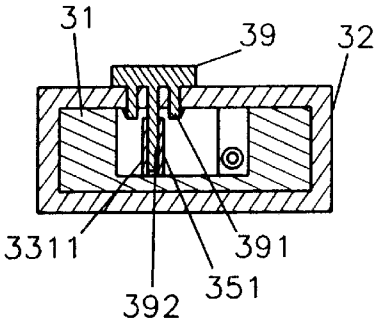
FIG. 11 is a sectional schematic view illustrating a slide block disposed on a housing of a second preferred embodiment.
Figure 12:
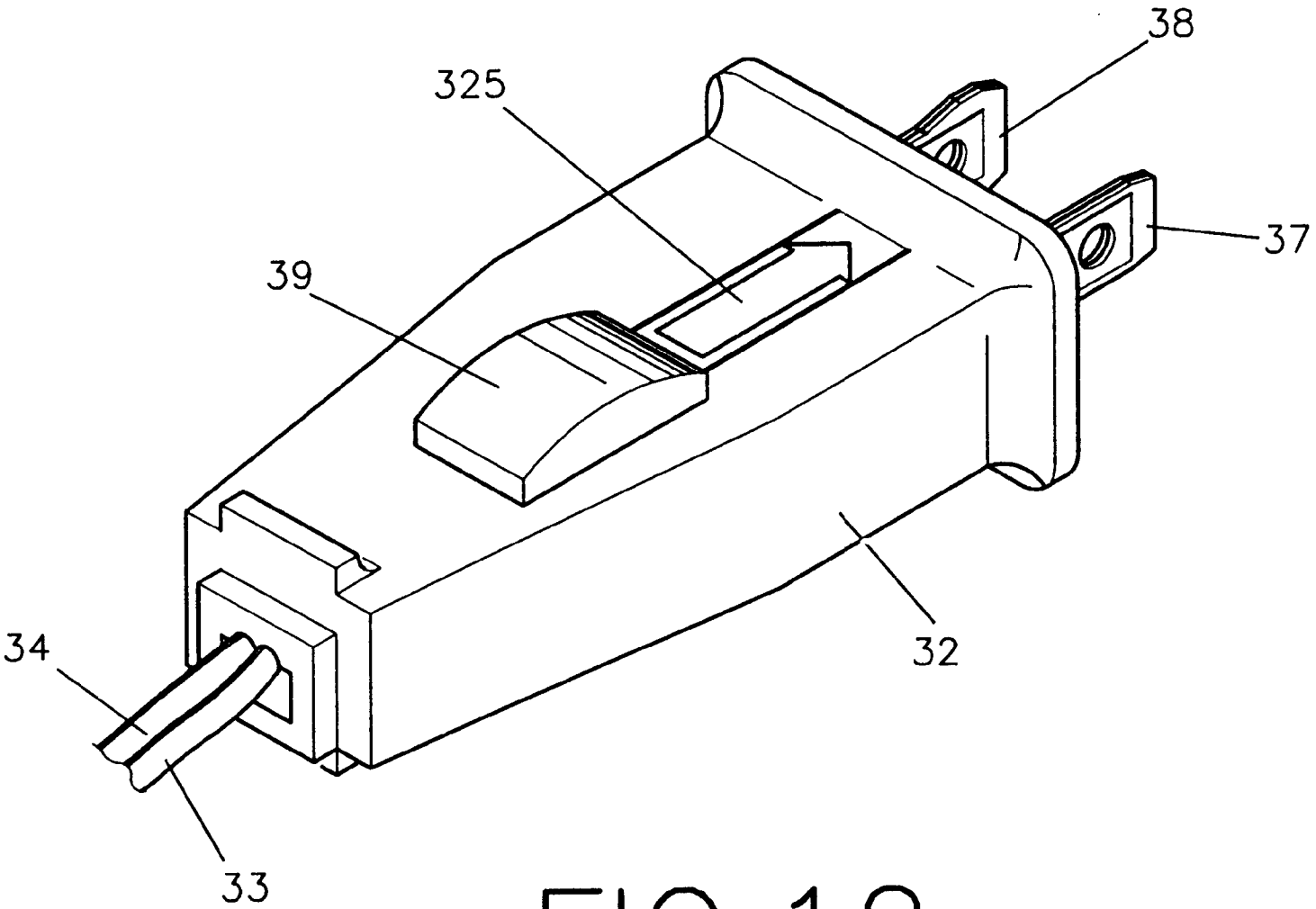
FIG. 12 is a perspective assembly view of a conductive plug device of a second preferred embodiment.

Referring to FIGS. 3 to 6, a first conductive plug device comprises a housing 22, a main body 21 inserted in the housing 22, and a slide block 26 disposed on the housing 22. The slide block 26 has a separator plate 262 and two insertion plates 261. The housing 22 has a first slot 222 receiving the separator plate 262, a second slot 221 receiving the respective insertion plate 261, and a third slot 223 receiving the respective insertion plate 261. A cover plate 211 is disposed in front of the main body 21. A first conductive plate 241 is disposed in the main body 21. A second conductive plate 231 is disposed in the main body 21. A curved plate 25 is disposed in the main body 21. The separator plate 262 is placed between the second conductive plate 23 and the curved plate 25. A first wire 24 is connected to the first conductive plate 241. A second wire 23 is connected to the second conductive plate 231. The second conductive plate 231 has a distal end 2311. The curved plate 25 has a curved end 251. When the distal end 2311 and the curved end 251 are contacted, the contact area between the second conductive plate 231 and the curved plate 25 are enlarged.

Referring to FIGS. 7 to 12, a second conductive plug device comprises a housing 32, a main body 31 inserted in the housing 32, and a slide block 39 disposed on the housing 32. The slide block 39 has a separator plate 392 and two insertion plates 391. The housing 32 has a first slot 322 receiving the separator plate 392, a second slot 321 receiving the respective insertion plate 391, a third slot 323 receiving the respective insertion plate 391, and a slide recess 324 having an is interior 3241 receiving a lower portion of a slide plate 325. A first conductive blade 38 is disposed in the main body 31. A second conductive blade 37 is disposed in the main body 31. A curved plate 35 is disposed in the main body 31. A conductive plate 331 is disposed in the main body 31. A fuse 36 is disposed between the second conductive blade 37 and the curved plate 35. The separator plate 392 is placed between the curved plate 35 and the conductive plate 331. A first wire 34 is connected to the first conductive blade 38. A second wire 33 is connected to the conductive plate 331.

The conductive plate 331 has a distal end 3311. The curved plate 35 has a curved end 351 and a protruded plate 352. When the distal end 3311 and the curved end 351 are contacted, the contact area between the conductive plate 331 and the curved plate 35 are enlarged.

Figure 13:
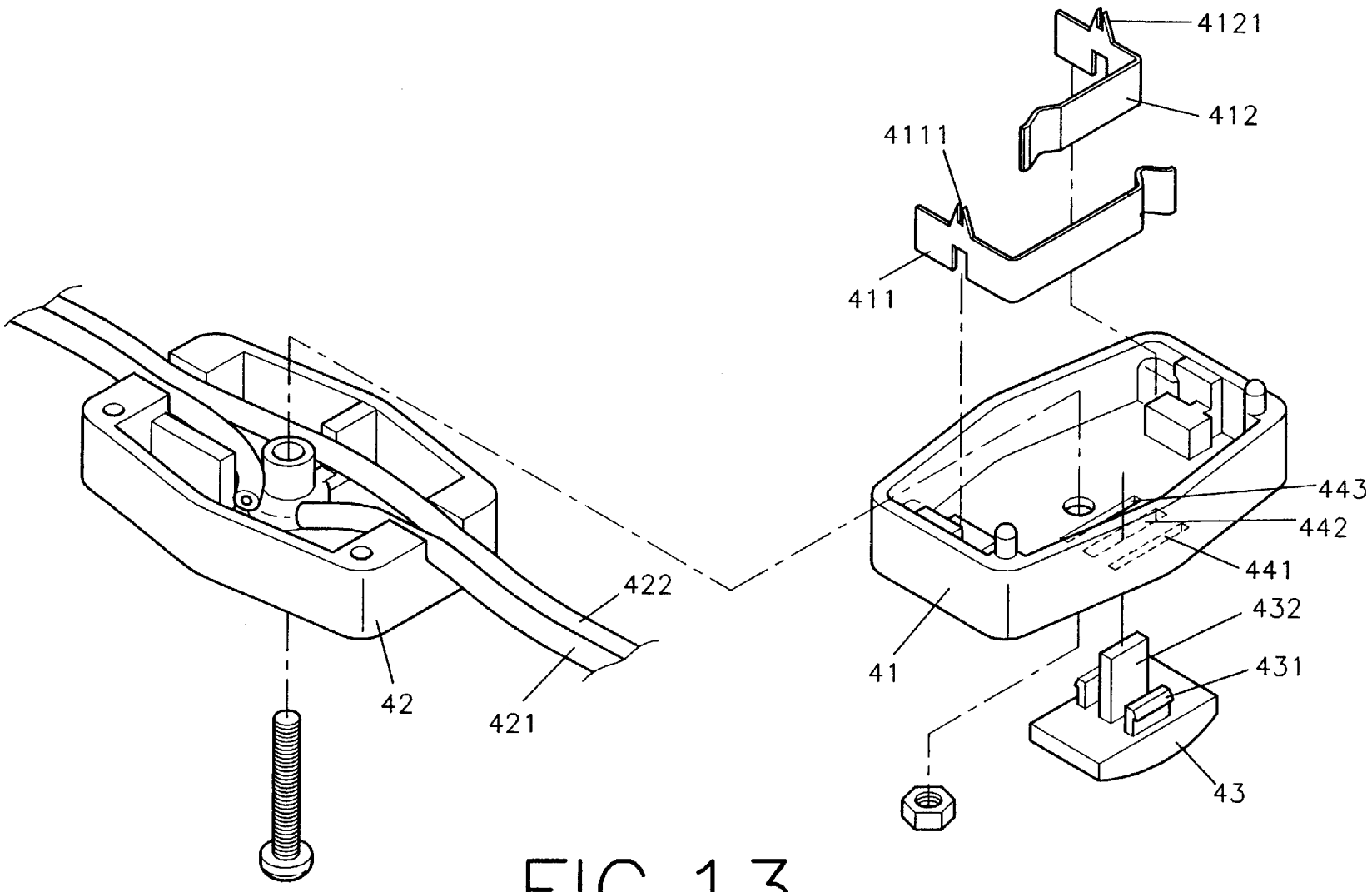
FIG. 13 is a perspective exploded view of a switch.
Figure 14:
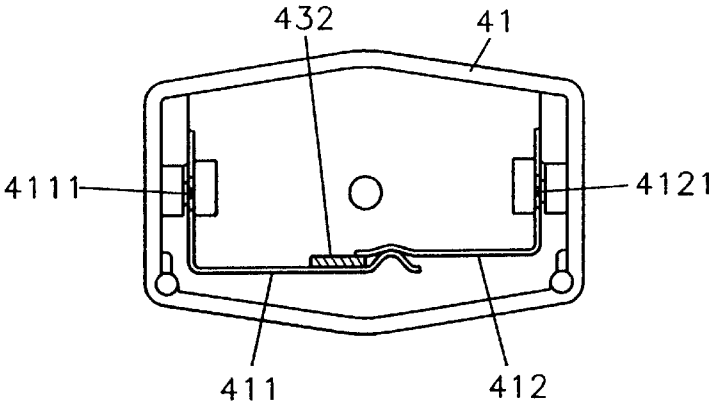
FIG. 14 is a sectional assembly view of a switch.
Figure 15:
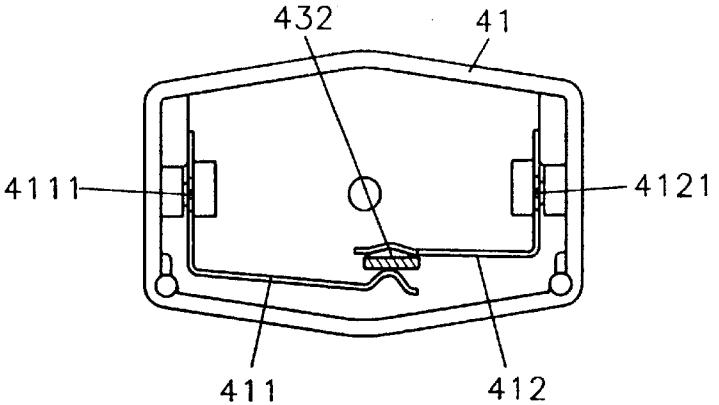
FIG. 15 is another sectional assembly view of a switch.

Referring to FIGS. 13 to 15, a switch device comprises a lower casing 42, an upper casing 41 engaged with the lower casing 42, and a slide block 43 disposed on the upper casing 41. A first and a second wires 421 and 422 are disposed in the lower casing 42. The slide block 43 has a separator plate 432 and two insertion plates 431. The upper casing 41 has a first slot 442 receiving the separator plate 432, a second slot 441 receiving the respective insertion plate 431, a third slot 443 receiving the respective insertion plate 431. A first conductive plate 411 is disposed between the lower casing 42 and the upper casing 41. A second conductive plate 412 is disposed between the lower casing 42 and the upper casing 41. The first conductive plate 411 has a serration tip 4111. The second conductive plate 412 has a toothed tip 4121. The separator plate 432 is placed between the first conductive plate 411 and the second conductive plate 412.

I claim:

1. A conductive plug device comprises:

a housing, a main body inserted in the housing, a slide block disposed on the housing, the slide block having a separator plate and two insertion plates, the housing having a first slot receiving the separator plate, a second slot receiving the respective insertion plate, and a third slot receiving the respective insertion plate, a cover plate disposed in front of the main body, a first conductive plate disposed in the main body, a second conductive plate disposed in the main body, a curved plate disposed in the main body, the separator plate placed between the second conductive plate and the curved plate, a first wire connected to the first conductive plate, and a second wire connected to the second conductive plate.

2. A conductive plug device comprises:

a housing, a main body inserted in the housing, a slide block disposed on the housing, the slide block having a separator plate and two insertion plates, the housing having a first slot receiving the separator plate, a second slot receiving the respective insertion plate, a third slot receiving the respective insertion plate, and a slide recess receiving a lower portion of a slide plate, a first conductive blade disposed in the main body, a second conductive blade disposed in the main body, a curved plate disposed in the main body, a conductive plate disposed in the main body, a fuse disposed between the second conductive blade and the curved plate, the separator plate placed between the curved plate and the conductive plate, a first wire connected to the first conductive blade, and a second wire connected to the conductive plate.

* * * * *